US005080783A

United States Patent [19]

Brown

[11] Patent Number: 5,080,783

[45] Date of Patent: Jan. 14, 1992

[54] APPARATUS FOR RECOVERING, SEPARATING, AND STORING FLUID FLOATING ON THE SURFACE OF ANOTHER FLUID

[76] Inventor: Neuberne H. Brown, 1495 S. Beach Rd., Hobe Sound, Fla. 33455

[21] Appl. No.: 570,323

[22] Filed: Aug. 21, 1990

[51] Int. Cl.[5] ..... E02B 15/04

[52] U.S. Cl. ..... 210/170; 210/242.3; 210/923; 220/560; 405/210

[58] Field of Search ..... 210/170, 242.1, 242.3, 210/513, 923, 358; 220/560.6; 405/210

[56] References Cited

U.S. PATENT DOCUMENTS

| | | | |
|---|---|---|---|
| 34,426 | 2/1862 | Howard | 405/210 |
| 61,880 | 2/1867 | Serrell | 210/923 |
| 2,924,350 | 2/1960 | Greer | 405/210 |
| 3,508,652 | 4/1970 | Woolley | 210/242.3 |
| 3,650,406 | 3/1972 | Brown et al. | 210/923 |
| 3,653,215 | 4/1972 | Crucet | 210/242.1 |
| 3,724,662 | 4/1973 | Ortiz | 210/923 |
| 3,966,614 | 6/1976 | Ayers | 210/923 |
| 4,046,691 | 9/1977 | Irons | 210/242.3 |
| 4,231,873 | 11/1980 | Swigger | 210/170 |
| 4,356,086 | 10/1982 | Oberg | 210/923 |
| 4,428,319 | 1/1984 | Henning et al. | 210/923 |
| 4,944,872 | 7/1990 | Kantor | 210/170 |
| 4,963,272 | 10/1990 | Garrett | 210/242.3 |

FOREIGN PATENT DOCUMENTS 1178071 5/1959 France .

*Primary Examiner*—Stanley S. Silverman
*Assistant Examiner*—Christopher Upton
*Attorney, Agent, or Firm*—Brumbaugh, Graves, Donohue & Raymond

[57] ABSTRACT

A lower density fluid that is substantially immiscible and is floating on the surface of a body of a higher density fluid is collected, separated and stored in the top part of a container having a roof, peripheral walls of flexible fluid-impermeable material and an opening in the bottom. The container is kept afloat in the body of higher density fluid by a floatation collar, and a submersion ring imparts shape to the peripheral walls. A mixture of fluids is skimmed from the surface of the body and is pumped into the container through inlets near the bottom. The lighter density fluid separates and floats in the top part of the container, and the higher density fluid is displaced through the opening in the bottom.

1 Claim, 2 Drawing Sheets

APPARATUS FOR RECOVERING, SEPARATING, AND STORING FLUID FLOATING ON THE SURFACE OF ANOTHER FLUID

BACKGROUND OF THE INVENTION

Spills into oceans, lakes and rivers from, for example, storage tank failures, ruptured vessels or vehicles, broken pipelines and offshore wells occur with alarming frequency and often cause immense damage to the ecology. The currently available equipment for dealing with spills has rarely proved adequate. The widely used containment booms are largely ineffective in confining a spill; currents as low as one mile-per hour cause the oil to pile up at the leeward end of the boom, and large quantities are forced under the skirt of the boom. When the spill is a flammable fluid, and is from a vessel, containment booms cannot be deployed around the vessel because of the fire hazard, and the spilled fluid has to be allowed to drift away from the vessel, thereby greatly increasing the difficulty of controlling and collecting it. Skimmer vessels for picking up the spilled fluid are rarely effective, especially when the spill has had time to spread.

There are two major inadequacies in presently available equipment for controlling and cleaning up spills. One is the lack of prompt availability of adequate storage units for the recovered fluid, which inevitably consists of large amounts of water mixed with the spilled fluid. For this reason extensive efforts have been made to separate the spilled fluid from the water before storing the spilled fluid, which greatly slows down the rate at which a given collection unit, such as a skimmer vessel, can operate. The second is the inability to get sufficient equipment to the site and deploy it quickly enough. Within a few hours after the spill, a slick has spread over so large an area that it is virtually impossible to confine and collect it.

U.S. Pat. No. 3,724,662 (Ortiz, Apr. 3, 1973) describes and shows equipment for capturing oil being discharged from a ruptured tanker or an underwater wellhead. The narrow mouth of a large conical bag is fitted to the vessel hull or the sea bottom at the location of the discharge. Floats support the top of the bag at the water surface. The oil collected in the bag rises to the surface and is pumped to nearby vessels by pumps carried in small boats commandeered for the purpose. The bag, pumps, hoses and other parts of the apparatus are designed to be airlifted to the spill site. The equipment of the Ortiz patent is intended to confine and collect oil leaking from a vessel or wellhead and is not suitable for collecting oil that has already escaped from the vessel or well and is floating on the water. The effectiveness of the Ortiz equipment depends almost entirely on how quickly it can be rigged and put into operation, thereby minimizing the amount of oil that escapes and forms a spreading slick on the water.

U.S. Pat. No. 4,356,086 (Oberg, Oct. 26, 1982) describes and shows apparatus for recovering oil from the surface of a body of water comprising containment booms towed by two small boats, a skimmer tank attached to the trailing ends of the booms and a tanker vessel equipped with a pump for sequentially pumping water from the bottom of the skimmer tank to draw the oil into it and pumping water into the skimmer tank to displace the oil into the tanker vessel. The equipment, particularly the storage component, is not suited to rapid deployment to a spill site, and the capacity of the equipment is relatively limited because of the dwell time for the separation process. Therefore, the rate of intake must be kept low to allow time for separation.

The apparatus of U.S. Pat. No. 4,428,319 (Henning et al., Jan. 31, 1984) uses a kit of relatively easily transported components (a skimming "sock," a separator tank, and a towable storage bag). Nonetheless, the host vessel for the kit, while it may be a work boat of general purpose use, must be located, commandeered, fitted with the equipment and sailed to the spill site. Valuable time may be lost while this occurs.

SUMMARY OF THE INVENTION

The present invention is an apparatus for recovering a lower density fluid that is immiscible or slightly miscible—i.e., substantially immiscible—in a higher density fluid and that is floating on the surface of a body of the higher density fluid, separating the lower density fluid from the higher density fluid, and storing the lower density fluid for an indefinite period of time. The apparatus comprises a container having a peripheral wall of a flexible fluid-impermeable material, a top wall joined in sealed relation to the peripheral wall and an opening in the bottom. A buoyant, substantially geometrically stable collar having a shape corresponding to that of the perimeter of the container is joined to the container at or near its upper end, and a weighted submersion ring is joined to the bottom of the perimeter wall. Each of a number of self-propelled collection vessels adapted to skim the fluids from the surface of the body carries a pump having an intake for receiving the skimmed fluids and an outlet for discharging them. A conduit connects the outlet of the pump of each vessel to an inlet close to the bottom of the container. The inlet should be far enough from the bottom of the container so that lighter fluid does not flow out through the bottom and should be relatively near the bottom so that the inflowing mixture does not agitate the separated lighter fluid collected in the container and thereby impede the separation process. By far the most important current use for the invention is in the control of oil spills, and the further description of the invention is, therefore, made in the context of oil spills in a body of water.

The apparatus may, of course, be used in conjunction with containment booms. The booms may be towed, or restrained against a current, to collect the spilled fluid at the leeward end, from which it can be pumped into the container. The boom may have a fitting at its leeward end serving as a skimmer and feeding a sump, in which the inlet to a pump is located. This equipment is functionally a form of skimmer vessel.

The peripheral wall of the container is, preferably, fabricated from a polymeric film or a plastic-coated or rubber-coated fabric. Ideally, the material used will have a density very close to that of water, so that the buoyant collar can be kept small. The top wall or roof of the container may also be made of a film or coated fabric, in which case it will be joined to the peripheral wall. In this form the container can be folded for storage and for transport to the spill site. The top wall of the container can also consist of or include transportable sections of a rigid material, such as laminates of sheets and rigid foam, constructed so as to be assembled at the site. Sections of rigid material can be inserted into the top of a container having a film or coated-fabric top wall to shape the top of the container. Buoyant top sheets may serve as the buoyant collar. One or more ports fitted with removable caps and, preferably, having couplings that accept hoses serve three purposes: first, air trapped in the container when it is being deployed can be vented; second, vapor from the fluid can be piped away and burned off; third, fluid stored in the container can be pumped out. In the case of the first purpose, it may be desirable to leave some air trapped in the container after it is deployed to contribute buoyancy.

The bottom opening of the container allows water trapped in the container when it is deployed to be displaced by the mixture of fluid and water pumped into it for storage and can be coextensive with the bottom edge of the peripheral wall—i.e., the container has no bottom wall. Alternatively, the container may have a bottom wall, preferably of a flexible material so that it can be folded, and joined to the bottom edge of the peripheral wall. One or more openings in the form of tubes extending from the bottom wall release displaced water when the container is being filled and can be tied off to close the container when it is full. This design allows the container to be towed without loss of contents.

The buoyant collar keeps the container afloat and generally shapes the upper portion. It may be an inflatable tube attached to the top of the container or an assembly of rigid closed tubes or tubes containing a buoyant material, such as a polymeric foam. Rigid tubes can be joined together end-to-end telescopically or by suitable couplings. The container can be joined to the collar by rings that fit around it or by simply tying the container to it.

The weighted ring, which shapes the bottom of the container, mainly by pulling the lower edge down, may be a length of cable suitably attached to the lower edge of the peripheral walls. The weight of the cable can be augmented by weights hung at intervals from the lower edge of the peripheral wall. Flexible metal sections can be joined to also provide a "hoop" configuration.

The container can be folded for storage and for air-lifting to the site. Similarly, the sections of the buoyant collar, the skimmer vessels, which can be inflatable-type boats, the pumps and engines for the skimmer vessels and the hoses are all suitable for air-lifting to the site of the spill. All components of the apparatus can be transported, if necessary, and dropped by parachute from cargo planes or can be transported and set down by helicopters. All components can be assembled as required for operation at the spill site.

The container may have a capacity of from several thousand to several hundred thousand gallons, say from 10,000 to 3,000,000. For example, a container having a diameter of 50 feet and a depth of 25 feet has a capacity of about 400,000 gallons. With such a large capacity many skimmer vessels can serve the container. Moreover, the large capacity container provides very effective separation, due to the long available residence time for the mixture, for even relatively high delivery rates. Therefore, the skimmer vessels can be designed to collect large amounts of water with the spilled fluid, thereby increasing the effectiveness of collection, even in rough seas. The large capacity for separating the oil from the water permits the skimmer vessels to operate at much greater throughput rates than conventional skimmers, the speeds of which are severely limited by slow oil/water separation devices. The abilities to get the equipment to a spill site quickly and to provide a high throughput provides the huge advantage of collecting the oil before it has time to spread over a large area. Enough collection equipment can be made available to keep ahead of spills of relatively high rates. The closed top of the container prevents loss of fluid and traps vapor, which reduces or eliminates the fire hazard. The container can and will drift to remain close to the spill as collective progress and after it is filled can be allowed to continue to drift or can be anchored. After sufficient time for nearly complete separation of the fluid from the water, the fluid can be pumped from the container to barges, a tanker, or another suitable storage or transport unit. With a container having bottom openings that can be closed the container can be towed to a more desirable discharge site. The fluid can also be left indefinitely in the container and treated chemically or biochemically to transform it to an ecologically acceptable form.

For a better understanding of the invention, reference may be made to the following description of an exemplary embodiments, taken in conjunction with the accompanying drawings.

DESCRIPTION OF THE EMBODIMENT

Figure 1:
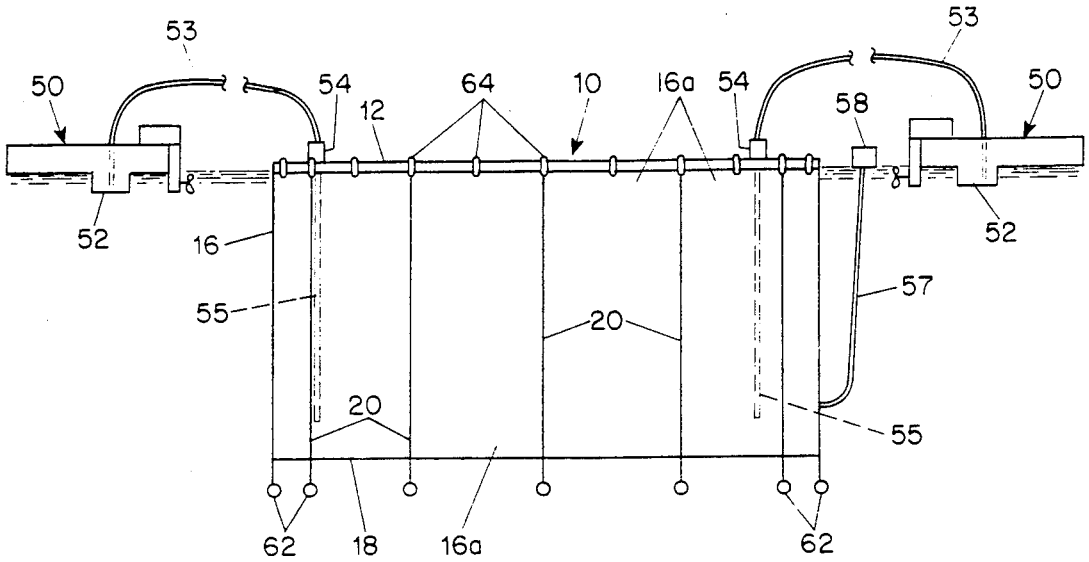
FIG. 1 is a generally schematic side elevational view of one embodiment.

A key component of the apparatus is a large container 10 that is floated in the water by a flotation collar 12 with its top wall 14 resting on or held just above the water surface and its perimeter wall 16 extended and shaped axially and circumferentially by a submersion collar 18. The container is made of a durable, flexible, vapor-impermeable material, such as a plastic film or a plastic-coated or rubber-coated fabric, by joining panels together, such as by sewing, an adhesive or thermal bonding. For example, the peripheral wall 16 may be formed by vertical panels **16*a* joined at seams 20, and the top wall 14 by pie-shaped panels 14*a* joined at seams 22. The top wall and peripheral wall are joined along a peripheral seam 24**.

Figure 3:
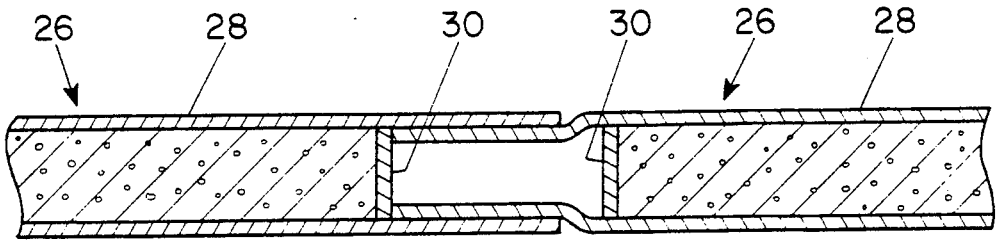
FIG. 3 is a detail side cross-sectional view of a portion of the collar.

The flotation collar 12 of the embodiment is made up of a number of identical sections 26 (FIG. 3). The lengths of the sections are chosen with a view to ease of transporting them and of handling them when the apparatus is being rigged. Each section is an aluminum tube 28, having a wall 30 at each end to make it air tight, and is filled with a closed cell plastic foam to provide stiffness, durability and buoyancy in case the section should leak. The ends of the sections are joined telescopically to provide a geometrically stable ring. If desired, the couplings may be secured by linchpins (not shown).

The skimmer vessels may be small inflatable pontoon boats 50, open at a blunt bow and having an adjustable lip (not shown) at the bow that can be set to a depth such as to maximize the proportion of spilled fluid collected from the surface of the water for the current sea conditions. The spilled fluid, along with some water, runs back along the bottom of the boat to pump 52 where the intake of a high volume pump is located. The discharge outlet of the pump is connected by a hose 53 to a coupling 54 in the container roof near the perimeter. Numerous couplings are provided and are of a quick-connect type with a built-in check valve. A flexible tube 55, which is secured in a suitable manner to the container peripheral wall 16 near the bottom edge (but far enough from the bottom so that collected fluid does not flow out through the bottom of the container) leads from each coupling 54. The outlet from each tube has a deflector/distributor that directs the flow laterally and minimizes turbulence. The spilled fluid and water enter the container and separate by gravity. As the spilled fluid accumulates in the upper part of the container, water is displaced through the open bottom. When the container is nearly full of a mixture of water and spilled fluid, that is, when the water-mixture interface nears the bottom, the mixture will pass up through a hose 57 into a transparent vessel 58 floating on the surface and tied up to the container. When the mixture is observed in the vessel 58, that is the indication that the vessel is full.

Figure 2:
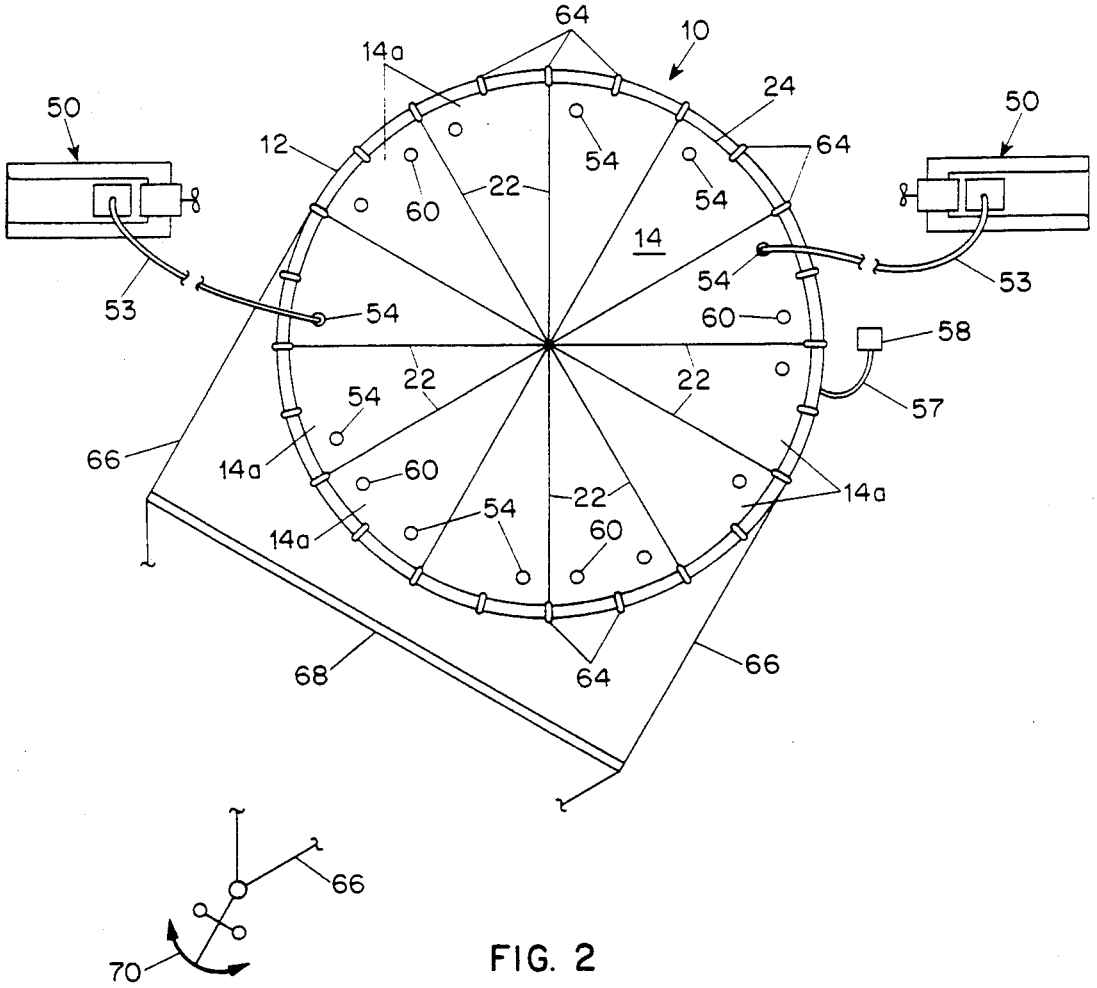
FIG. 2 is a generally schematic top plan view of the embodiment of FIG. 1.

The roof 14 of the container has several quick release couplings 60 (FIG. 2) near the perimeter which allow removal of the separated spilled fluid, removal of vapor for burning off at a distance from the spill site, and release of trapped air when the container is deployed.

The submersion collar 18 on the bottom of the container 10 holds the peripheral wall 16 taut so that it hangs vertically from the flotation collar and thereby provides both circumferential and vertical geometric stability to the container. The collar 18 is a length of cable suitably secured to the bottom edge of the peripheral wall and joined together at the ends. Weights 62 are tied to the cable at a intervals. The roof of the container 10 is attached to the flotation collar by rings 64.

All of the equipment can be designed to be air-lifted by plane or helicopter to a spill site and dropped or set down near the oil spill. All non-buoyant components—hoses, the container, the submersion collar, etc.—are packed in floats.

Generally, the container can be allowed to drift with the slick during recovery of the spilled fluid, but it can also be anchored by anchor lines 66 attached to opposite sides of the flotation collar, held apart by a boom 68 and leading to an anchor 70. After cleanup, the container my continue to drift or it may be anchored and left for an indefinite period. In time the lower density, substantially immiscible fluid recovered from the spill separates nearly completely from the water.

Figure 4:
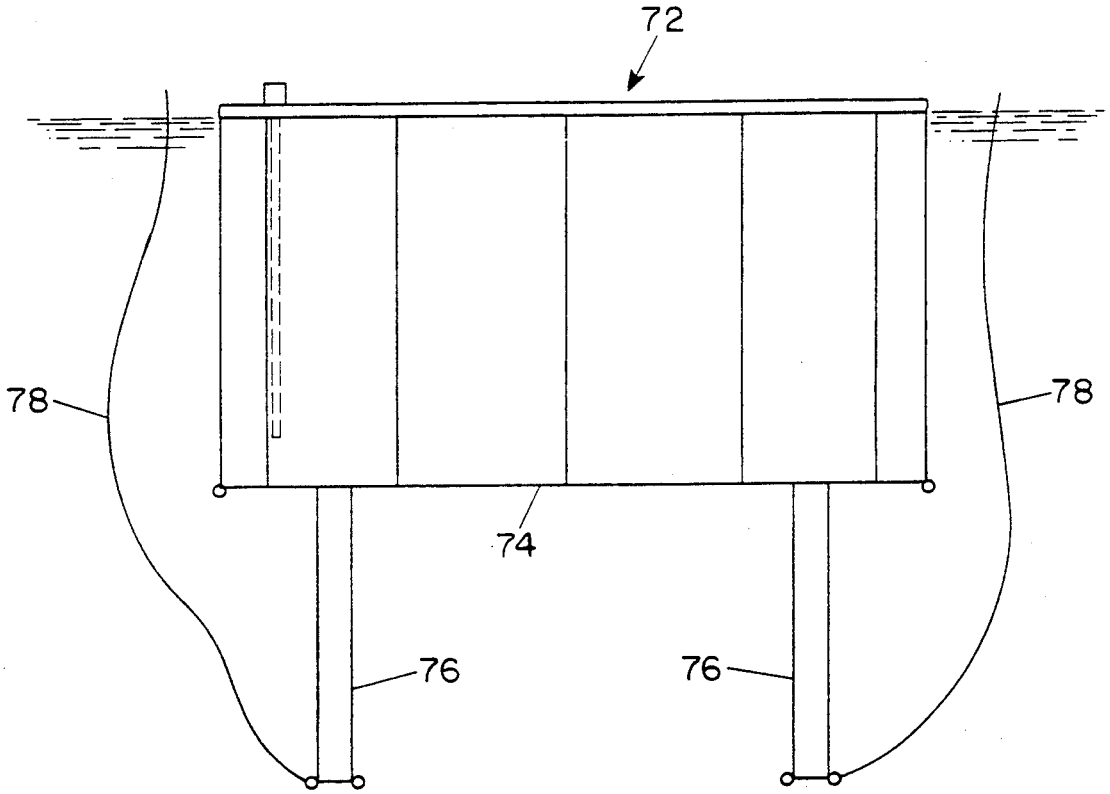
FIG. 4 is a side elevational view of a second embodiment.

A modified form of container 72, which is shown in FIG. 4, includes a bottom wall 74 having several flexible tubes 76 connected to the bottom wall around holes. The free ends of the tubes 76 are weighted and are connected to lines 78 made fast at the surface. When the container 72 is full, the ends of the tubes are pulled to the surface, using the lines, and are tied off. The container 72 can be towed.

The material of the peripheral walls of the container should have a density just slightly greater than that of water so that the size of the flotation collar can be minimized. The top wall can have a density slightly less than water so that it will float. Alternatively, some air can be left trapped in the container when it is deployed to keep a non-buoyant top wall afloat.

Because the container is always substantially completely filled with liquid (water when first deployed and a mixture of water and the spilled fluid as collection proceeds), it is geometrically stable because there is no pressure difference between the interior and exterior. Although the upper part of the container is subject to wave action, the effect diminishes rapidly beginning a small distance below the surface. As the container fills with the lower density spilled liquid and the liquid separates and floats in the top part of the container, the container will float progressively higher in the water. The pressure against the peripheral wall of the spilled liquid that fills the part of the container floating above the surface enhances the geometric stability of the upper part of the container.

I claim:

1. Apparatus for collecting a lower density fluid that is substantially immiscible in water and is floating on the surface of a body of a higher density fluid, separating the lower density fluid from the higher density fluid and storing the lower density fluid comprising a container having a peripheral wall of a flexible fluid-impermeable material, the peripheral wall having a top edge and a bottom edge, a roof joined in sealed relation to the peripheral wall adjacent its top edge, and an opening in the bottom, the container being adapted to be stored and transported in folded condition; a buoyant substantially geometrically stable collar having a shape-corresponding to that of the perimeter of the container, the collar being composed of a multiplicity of sections, which are of a size such that they can be stored and transported conveniently and means for releasably joining the sections end to end; means for joining the container to the collar; a weighted submersion ring, means for joining the submersion ring to the peripheral wall adjacent its bottom edge; a plurality of collection vessels adapted to skim the fluids from the surface of the body of higher density fluid; a pump associated with each vessel having an intake for receiving the skimmed fluids and an outlet for discharging the fluids; and conduit means connecting the outlet of the pump of each vessel to an inlet into the container located proximate to the bottom edge such that the fluids pumped from the vessel are confined within the container, the conduit means being of lengths sufficient to enable the skimmer vessels to move substantial distances relative to the container while the container either drifts or is anchored as it is being filled from the skimmer vessels.

* * * * *